US007291965B1

(12) United States Patent
Seo

(10) Patent No.: US 7,291,965 B1
(45) Date of Patent: Nov. 6, 2007

(54) VACUUM VESSEL AND ELECTRON EMISSION DISPLAY DEVICE USING THE SAME, PROVIDED WITH SPACER SUPPORTS IN NON-ACTIVE AREA OF THE DISPLAY

(75) Inventor: Hyoung-Cheol Seo, Chunan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/506,853

(22) Filed: Aug. 21, 2006

(30) Foreign Application Priority Data

Oct. 31, 2005 (KR) ..... 10-2005-0103511

(51) Int. Cl.
*H01J 1/88* (2006.01)
*H01J 1/90* (2006.01)
*H01J 19/42* (2006.01)

(52) U.S. Cl. ..... 313/495; 313/292; 313/496; 313/497

(58) Field of Classification Search ..... 313/495–497, 313/292
See application file for complete search history.

(56) References Cited

U.S. PATENT DOCUMENTS 4,363,648 A * 12/1982 Allaire et al. ..... 65/42
5,821,689 A * 10/1998 Andoh et al. ..... 313/495
6,133,689 A * 10/2000 Watkins et al. ..... 313/495
6,486,610 B2 * 11/2002 Kojima et al. ..... 315/169.3
6,571,464 B2 * 6/2003 Fahlen et al. ..... 29/825
6,803,715 B1 * 10/2004 Mitsutake et al. ..... 313/495
7,132,026 B2 * 11/2006 Shioya et al. ..... 313/495
2004/0108044 A1 * 6/2004 Shioya et al. ..... 156/160
2004/0113540 A1 * 6/2004 Niibori et al. ..... 313/495
2004/0245916 A1 * 12/2004 Hiroike et al. ..... 313/495
2005/0206291 A1 * 9/2005 Hirasawa et al. ..... 313/292

* cited by examiner

*Primary Examiner*—Mariceli Santiago
(74) *Attorney, Agent, or Firm*—Robert E Bushnell, Esq.

(57) ABSTRACT

A vacuum vessel that includes a first and a second substrate facing each other and extending across both an active area and a non-active area surrounding the active area, a sealing member arranged at peripheries of the first and the second substrates and adapted to maintain a vacuum between the two substrates, a plurality of wall type spacers arranged between the first and the second substrates while extending across the active area and a plurality of spacer supports arranged in the non-active area between the first and the second substrates, the plurality of spacer supports including a plurality of grooves adapted to receive the ends of respective ones of the plurality of wall type spacers, each spacer support having a height identical to or greater than a height of the plurality of wall type spacers.

20 Claims, 7 Drawing Sheets

VACUUM VESSEL AND ELECTRON EMISSION DISPLAY DEVICE USING THE SAME, PROVIDED WITH SPACER SUPPORTS IN NON-ACTIVE AREA OF THE DISPLAY

CLAIM OF PRIORITY

This application makes reference to, incorporates the same herein, and claims all benefits accruing under 35 U.S.C. § 119 from an application earlier filed in the Korean Intellectual Property Office on 31 Oct. 2005 and there duly assigned Serial No. 10-2005-0103511.

BACKGROUND OF THE INVENTION

1. Field of the Invention

The present invention relates to a vacuum vessel, and in particular, to a vacuum vessel which has built-in spacers for spacing first and second substrates apart from each other by a predetermined distance, and an electron emission display device using the vacuum vessel.

2. Description of the Related Art

Generally, electron emission devices are classified into those using hot cathodes as an electron emission source and those using cold cathodes as the electron emission source. There are several types of cold cathode electron emission devices, including a field emitter array (FEA) type, a metal-insulator-metal (MIM) type, a metal-insulator-semiconductor (MIS) type, and a surface conduction emitter (SCE) type.

Although the electron emission devices are differentiated by specific structure depending upon the types thereof, they all basically have electron emission regions formed on a substrate, and driving electrodes for controlling the on/off and amount of electron emission from the electron emission regions. The electron emission devices can be used as an electron emission structure for a light source, such as a backlight or an image display device.

With the typical structure of the electron emission display device using the electron emission device, electron emission regions and driving electrodes are formed on a first substrate, and phosphor layers are formed on a surface of a second substrate facing the first substrate together with an anode electrode that keeps the phosphor layers at a high potential state. The first and the second substrates are sealed together at their peripheries using a sealing member, and the interior thereof is exhausted to form a vacuum vessel so that the electrons can be fluently emitted and migrated therein. A strong compression force is applied to the vacuum vessel due to the pressure difference between the interior and exterior thereof. A plurality of spacers are provided within the vacuum vessel to prevent vacuum vessel from breaking due to the compressive force. The spacers are attached to any one of the first the second substrates using an adhesive layer, and placed within the active area along with the electron emission regions and the phosphor layers.

With such a vacuum vessel, when spacers are fitted to one of the first and the second substrates and the interior thereof is evacuated, the spacers and the other of the first and the second substrates spaced apart from each other without an intervening adhesive layer are held tightly in contact with each other so that an impact is applied to the spacers, and the spacers are liable to be broken due to this impact.

The electron emission display device further has a non-active area located between the active area and the sealing member that does not serve to display an image. With the distribution of the stresses applied to the first and the second substrates after the exhausting, the stress applied to the non-active area is greater than the stress applied to the active area. This is because the structure for absorbing and withstanding the pressure of the two substrates is not present in the non-active area. Accordingly, cracks are likely to occur in the vacuum vessel due to the relatively large stress in the non-active area.

As spacers are attached to the substrate using an adhesive layer, the adhesion thereof with respect to the substrate is relatively weak. Consequently, some spacers are inclined or detached from the substrate during the exhausting process so that the pressure applied to the vacuum vessel is not uniformly distributed. As a result, the inclined spacers can block the paths of the electron beams, thus deteriorating the display characteristic. Moreover, as the wall type spacers have a high sectional aspect ratio and a long length, they are prone to twisting. For this reason, in a vacuum vessel using the wall type spacers, the spacers are likely to be twisted or inclined after the exhausting. Therefore, what is needed is an improved design for a vacuum vessel and an electron emission display device having the same that is better able to withstand and absorb the pressure caused by the vacuum vessel while overcoming the above problems.

SUMMARY OF THE INVENTION

It is therefore an object of the present invention to provide an improved design for a vacuum vessel and an improved design for an electron emission display employing the vacuum vessel.

It is also an object of the present invention to provide a vacuum vessel which inhibits the breakage of spacers due to the impact applied thereto during the exhausting process, and an electron emission display device using the vacuum vessel.

It is yet an object of the present invention to provide a vacuum vessel which reduces the stress applied to the non-active area of first and second substrates to thus inhibit the occurrence of cracks in the vacuum vessel.

It is still another object of the present invention to provide a vacuum vessel which heightens the adhesion of the spacers with respect to the first or the second substrate to thus prevent the spacers from being inclined or detached from the substrate, and an electron emission display device using the vacuum vessel.

These and other objects can be achieved by a vacuum vessel and an electron emission display device employing the same as follows.

According to one aspect of the present invention, there is provided a vacuum vessel that includes a first and a second substrate facing each other and extending across both an active area and a non-active area surrounding the active area, a sealing member arranged at peripheries of the first and the second substrates and adapted to maintain a vacuum between the two substrates, a plurality of wall type spacers arranged between the first and the second substrates while extending across the active area and a plurality of spacer supports arranged in the non-active area between the first and the second substrates, the plurality of spacer supports including a plurality of grooves adapted to receive the ends of respective ones of the plurality of wall type spacers, each spacer support having a height identical to or greater than a height of the plurality of wall type spacers.

Each of said plurality of spacer supports can include one of said plurality of grooves that is adapted to accommodate one end of one of said plurality of wall type spacers, each of said plurality of wall type spacers corresponding to two of said plurality of spacer supports, one for each end of said one of said plurality of wall type spacers. The vacuum vessel can include two spacer supports, each of said two spacer supports including a plurality of grooves adapted to accommodate ends of corresponding ones of said plurality of wall type spacers. A distance between a pair of the plurality of grooves that are arranged opposite to each other with one of said plurality of wall type spacers arranged between can be larger than a length of said one of said plurality of wall type spacers. A height difference between each of said plurality of wall type spacers and each of said plurality of spacer supports can be no more than 10% of a height of each of said plurality of wall type spacers. The vacuum vessel can also include an adhesive adapted to attach the plurality of spacer supports to one of the first and the second substrates.

According to another aspect of the present invention, there is provided and electron emission display device that includes a first and a second substrate facing each other and extending across both an active area and a non-active area surrounding the active area, an electron emission unit arranged within the active area and on the first substrate, a light emission unit arranged within the active area and on the second substrate, a sealing member arranged at peripheries of the first and the second substrates and adapted to maintain a vacuum between the two substrates, a plurality of wall type spacers arranged between the first and the second substrates while extending across the active area and a plurality of spacer supports arranged in the non-active area between the first and the second substrates, the plurality of spacer supports including a plurality of grooves adapted to receive the ends of respective ones of the plurality of wall type spacers, each spacer support having a height identical to or greater than a height of the plurality of wall type spacers.

Each of said plurality of spacer supports can include one of said plurality of grooves that is adapted to accommodate one end of one of said plurality of wall type spacers, each of said plurality of wall type spacers corresponding to two of said plurality of spacer supports, one for each end of said one of said plurality of wall type spacers. The electron emission display device can include two spacer supports, each of said two spacer supports including a plurality of grooves adapted to accommodate ends of corresponding ones of said plurality of wall type spacers. A distance between a pair of the plurality of grooves that are arranged opposite to each other with one of said plurality of wall type spacers arranged between can be larger than a length of said one of said plurality of wall type spacers. A height difference between each of said plurality of wall type spacers and each of said plurality of spacer supports can be no more than 10% of a height of each of said plurality of wall type spacers. The electron emission display device can also include an adhesive adapted to attach the plurality of spacer supports to one of the first and the second substrates. The electron emission unit can include a plurality of electron emission regions adapted to emit electrons and a driving electrode adapted to control the emission of electrons from the plurality of electron emission regions, the light emission unit can include a plurality of phosphor layers and an anode electrode adapted to apply a high potential to the plurality of phosphor layers.

According to still yet another aspect of the present invention, there is provided an electron emission display device that includes a first substrate spaced apart from and facing a second substrate and spanning an active area and a non-active area surrounding the active area, an electron emission unit arranged on the first substrate within the active area, a light emission unit arranged on the second substrate within the active area, a sealing member arranged at peripheries of the first and the second substrates and in the non-active area, the sealing member being adapted to maintain a vacuum between the first and the second substrates, a plurality of wall type spacers arranged between the first and the second substrates and extending across the active area, the plurality of wall type spacers being adapted to keep said first substrate spaced apart from the second substrate and to absorb and withstand a pressure in the active area acting on the first and the second substrates due to said vacuum between the first and the second substrates and a plurality of spacer supports arranged within the non-active area between the first and the second substrates at ends of ones of the plurality of wall type spacers, the plurality of spacer supports being adapted to keep said first substrate spaced apart from said second substrate and to absorb and withstand a pressure in the non active area acting on the first and the second substrates due to said vacuum between the first and the second substrates.

Each of the plurality of spacer supports can be wider than each of the plurality of wall type spacers. Each of the plurality of spacer supports can be taller than each of the plurality of wall type spacers by no more than 10% of a height of each of the plurality of wall type spacers. The plurality of wall type spacers can have a stripe pattern. Each of the plurality of spacer supports can include one groove adapted to receive one end of one of said plurality of wall type spacers. Each of the plurality of spacer supports can include a plurality of grooves adapted to receive one end of a corresponding plurality of wall type spacers.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
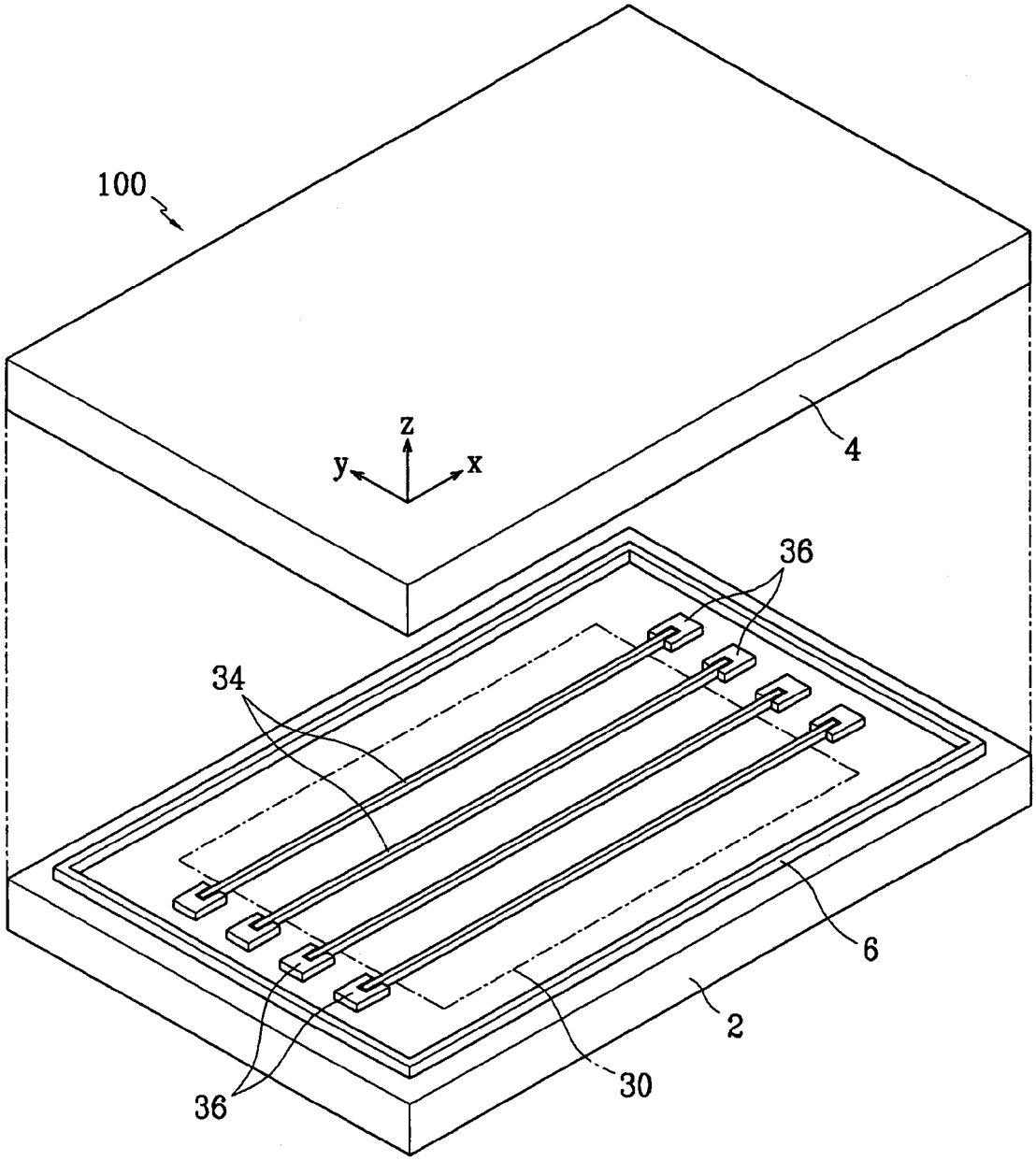
FIG. 1 is an exploded perspective view of an electron emission display device according to an embodiment of the present invention.
Figure 2:
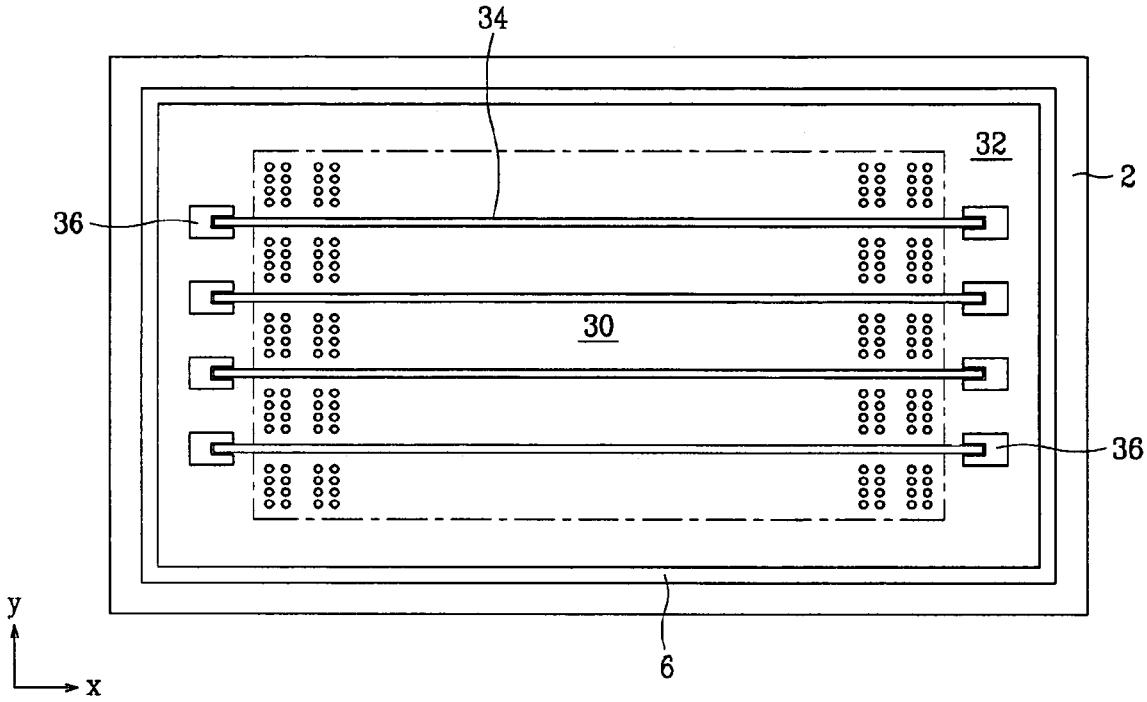
FIG. 2 is a plan view of the structural components of the electron emission display device shown in FIG. 1 absent the second substrate.

Turning now to FIGS. 1 and 2, the electron emission display device has a vacuum vessel 100 that includes first and second substrates 2 and 4 spaced apart from each other by a predetermined distance, and a sealing member 6 along the peripheries of the first and the second substrates 2 and 4 to seal the substrates together. The interior of the vacuum vessel 100 is exhausted and maintained at pressure of $10^{-6}$ Torr.

An electron emission unit is provided on the surface of the first substrate 2 that faces the second substrate 4 and serves to emit electrons toward the second substrate 4. A light emission unit is provided on the surface of the second substrate 4 that faces the first substrate 2 and serves to emit visible rays when impinged by the electrons emitted from the electron emission unit, thus producing the visible image for the display.

Figure 3A:
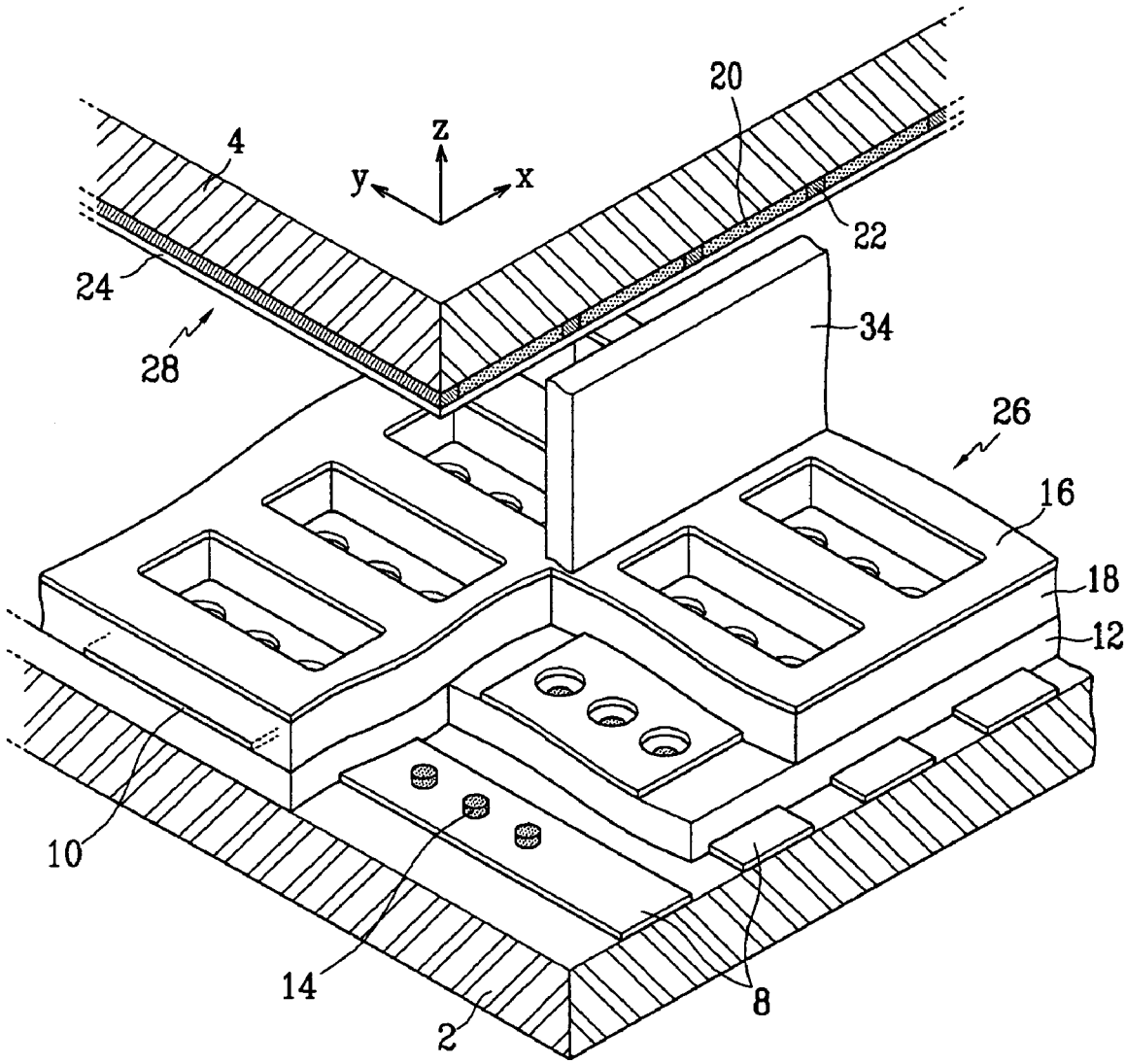
FIG. 3A is a partial exploded perspective view of a portion of the electron emission display device of FIG. 1.

Turning now to FIG. 3A, FIG. 3A is a partial exploded perspective view of an electron emission display device 100 of FIG. 1, illustrating the electron emission unit 26 and the light emission unit 28 for an FEA type electron emission display device. As shown in FIG. 3, in the FEA type electron emission display device 100, cathode electrodes 8 are the first electrodes, and gate electrodes 10 are the second electrodes. The cathode electrodes 8 and the gate electrodes 10 cross each other on the first substrate 2 and have a first insulating layer 12 arranged therebetween. Electron emission regions 14 are formed on the cathode electrodes 8 at the crossed regions of the cathode and the gate electrodes 8 and 10. Openings are formed in the first insulating layer 12 and in the gate electrodes 10 corresponding to the respective electron emission regions 14. These openings expose the electron emission regions 14.

The electron emission regions 14 are made out of a material that can emit electrons upon application of an electric field under a vacuum atmosphere. Examples of such materials that can be used in the electron emission regions 14 are carbonaceous material and nanometer-sized material. Specific examples of materials that can be used in the electron emission regions 14 include carbon nanotubes, graphite, graphite nanofiber, diamond, diamond-like carbon, $C_{60}$, silicon nanowire or a combination thereof. The cathode electrodes 8 and the gate electrodes 10 function as driving electrodes for controlling the emission of the electron emission regions 14.

Although the gate electrodes 10 are shown in FIG. 3A to be placed over the cathode electrodes 8 on the first substrate 2 with an intervening first insulating layer 12, it is also possible to arrange the gate electrodes 10 underneath the cathode electrodes 8 while interposing the first insulating layer 12. When the gate electrodes 10 are arranged underneath the cathode electrodes 8, the electron emission regions 14 are arranged to contact the lateral surface of the cathode electrodes 8 on the first insulating layer 12.

Reverting back to the scenario where the gate electrodes 10 are formed over the cathode electrodes 8, a focusing electrode 16 is formed on top of the gate electrodes 10 and on top of the first insulating layer 12. This focusing electrode 16 serves as the third electrode. A second insulating layer 18 is placed under the focusing electrode 16 to insulate the focusing electrode 16 from the gate electrodes 10. Openings are formed in the second insulating layer 18 and in the focusing electrode 16 to allow electron beams to pass.

Figure 3B:
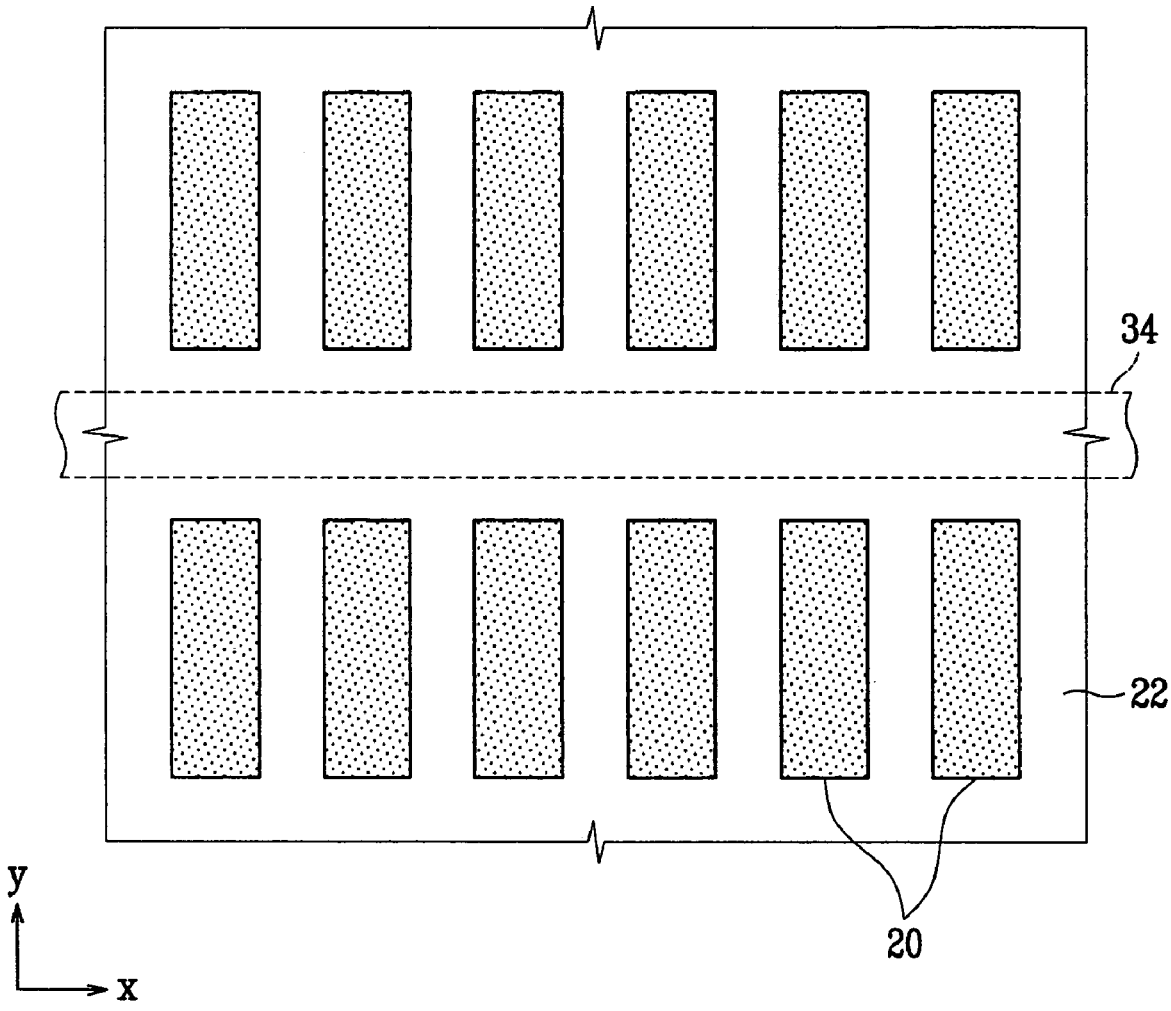
FIG. 3B is a partial plan view of a portion of the electron emission display device of FIG. 1.

FIG. 3B is a partial plan view of the electron emission display device 100 of FIG. 1. Turning now to FIGS. 3A and 3B, in the light emission unit 28 on the second substrate 4, phosphor layers 20 and black layers 22 are formed on the surface of the second substrate 4 that faces the first substrate 2. An anode electrode 24 is formed over the phosphor layers 20 and over the black layers 22. A metallic material such as aluminum can be used for the anode electrode 24. The anode electrode 24 receives a high voltage required for accelerating the electron beams. The anode electrode 24 also serves to reflect visible rays radiated from the phosphor layers 20 that travel away from the second substrate 4 towards the first substrate 2, thus heightening the screen luminance.

In a variation to the above, the anode electrode 24 can instead be made out of a transparent conductive material such as indium tin oxide (ITO). When the anode electrode 24 is transparent, the anode electrode is situated on a side of phosphor layers 20 and the black layers 22 facing the second substrate 4. Further, the anode electrode 24 can be patterned to have a plurality of separate portions. Again alternatively, the anode electrode 24 can be formed as a double-layered structure having a transparent conductive material-based layer and a metallic material-based layer.

The structures of the electron emission unit 26 and the light emission unit 28 are in no way limited to that illustrated or described. Furthermore, the electron emission display device according to the present invention is in no way limited to the FEA type device, but can be another type, such as an SCE type, an MIM type or an MIS type and still be within the scope of the present invention.

The area of the first and the second substrates 2 and 4 where the electron emission unit 26 and the light emission unit 28 are located (i.e., the area where the image is produced) is referred to the active area 30. The non-active area 32 is located external to the active area 30, between the active area 30 and the sealing member 6. An exhaust port, electrode wires and a getter (not shown) are provided in the non-active area 32.

With the above-described structure, a plurality of wall type spacers 34 are arranged between the first and the second substrates 2 and 4 while extending across the active area 30. Spacer supports 36 are further arranged at each end of each of the wall type spacers 34. The spacer supports 36 are located within the non-active area 32 and contain grooves 38 that receive ends of the spacers 34.

As illustrated in FIG. 2, each spacer 34 has a length that is greater than the active area 30 that the spacer 34 extends across. Although FIG. 2 shows each spacer 34 as extending across the active area 30 in a direction of the long axis of the active area 30, each spacer instead can extend in a direction of the short axis of the active area 30 and still be within the scope of the present invention. The width of the spacers 34 should be small enough so they can not seen on the screen. The spacers 34 are arranged between adjacent gate electrodes 10 and thus correspond to the black layers 22 so that the spacers 34 do not obstruct the electron beams and do not obstruct the light emitted from the phosphor layers 20.

Figure 4:
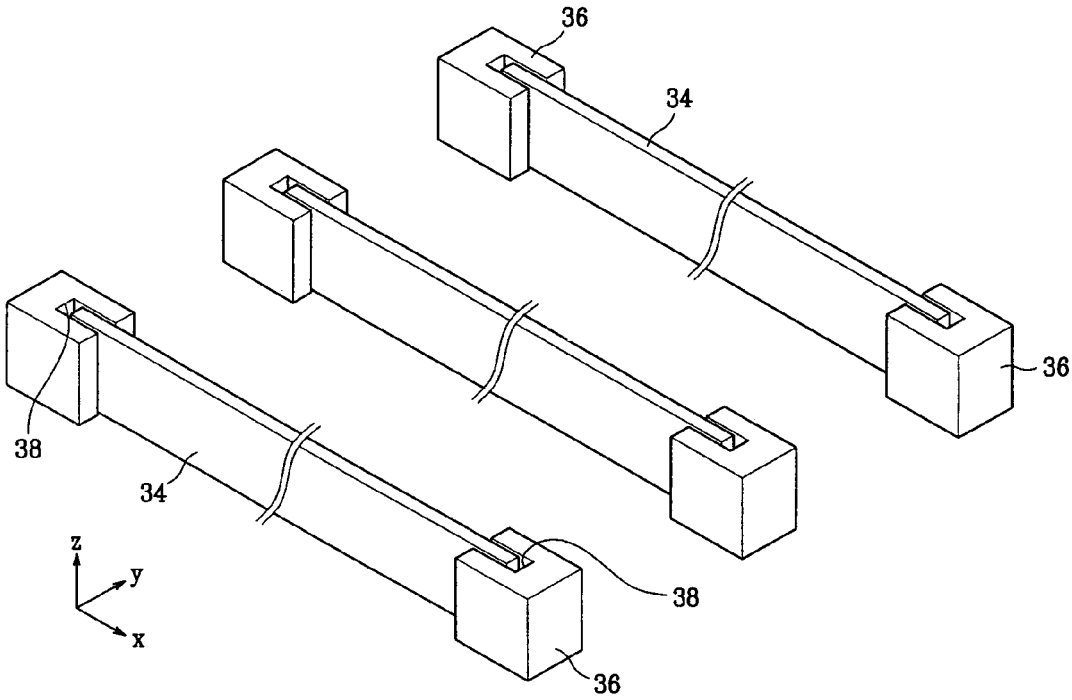
FIG. 4 is an amplified perspective view of the spacers and the spacer supports shown in FIG. 1.
Figure 5:
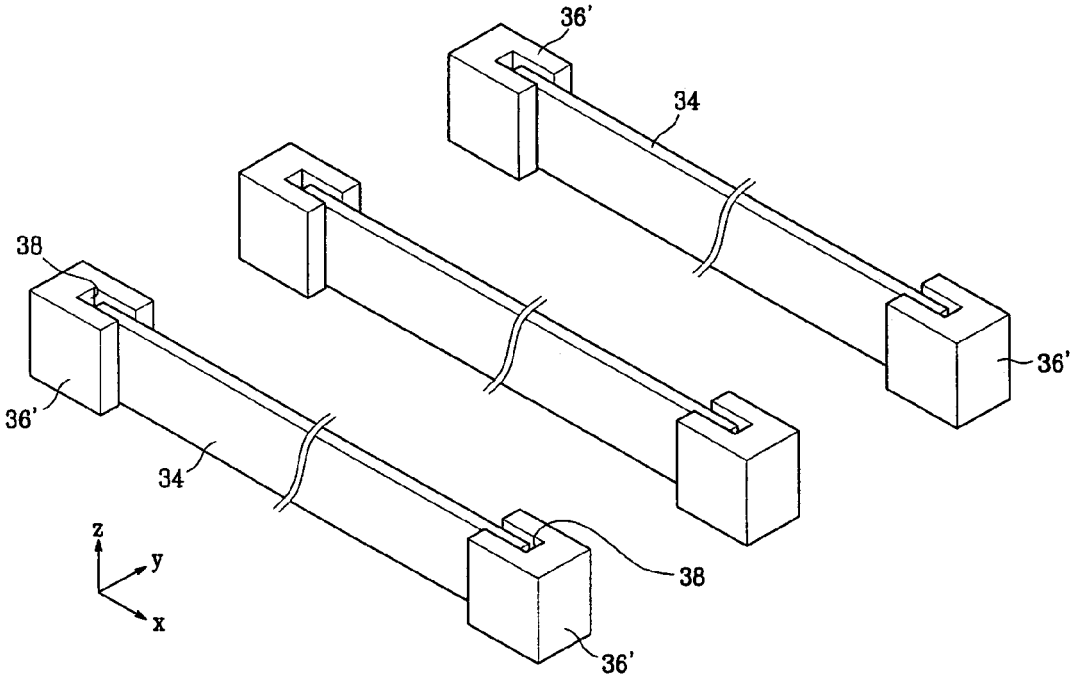
FIG. 5 is a perspective view of the spacers and the spacer supports, illustrating a first variant of the spacer supports.

As illustrated in FIGS. 4 and 5, a pair of spacer supports 36 correspond to each spacer 34. A spacer support 36 is located at each end of each spacer 34. Grooves 38 are formed in the sides of the spacer supports 36. These grooves 38 face the active area 30. Grooves 38 in spacer support 36 serve to hold an end of a spacer support 34. Further, the spacer supports 36 are attached to one of the first and the second substrates 2 and 4 using an adhesive. The spacers 34 are then fitted into the grooves 38 of the spacer supports 36.

The height of the spacer supports 36 can be the same as the height of the spacers 34 or can be slightly taller than the spacers 34. The spacer supports 36 serve to absorb and withstand the pressure applied to the first and the second substrates 2 and 4 in the non-active area 32. The case where the height of the spacer supports 36 are the same as that of the spacers 34 is illustrated in FIG. 4. The case where the height of the spacer supports 36' are slightly larger than that of the spacers 34 is illustrated in FIG. 5.

When the height of the spacer supports 36' is established to be larger than that of the spacers 34, the spacer supports 36' bear the brunt of the pressure applied to the first and the second substrates 2 and 4 in the non-active area 32 while the spacers 34 bear the brunt of the pressure applied to the first and the second substrates 2 and 4 in the active area 30, thus preventing excessive stress from occurring in the non-active area 32. Accordingly, even after the exhausting process is completed, the first and the second substrates 2 and 4 remain in a stable state, and the stress difference between the active area 30 and the non-active area 32 is minimized. Furthermore, when the height of the spacer supports 36' are larger than that of the spacers 34 as in FIG. 5, the spacer supports 36' also serve to reduce impact applied to the spacers 34 during the exhausting process.

Figure 6:
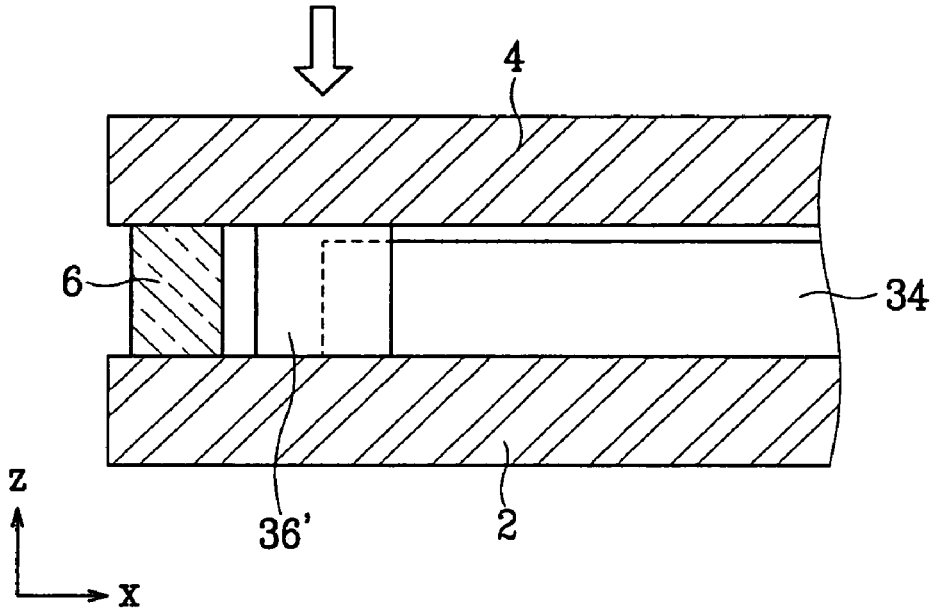
FIGS. 6 and 7 are partial sectional views of a vacuum vessel for an electron emission display device, illustrating the exhausting process thereof.
Figure 7:
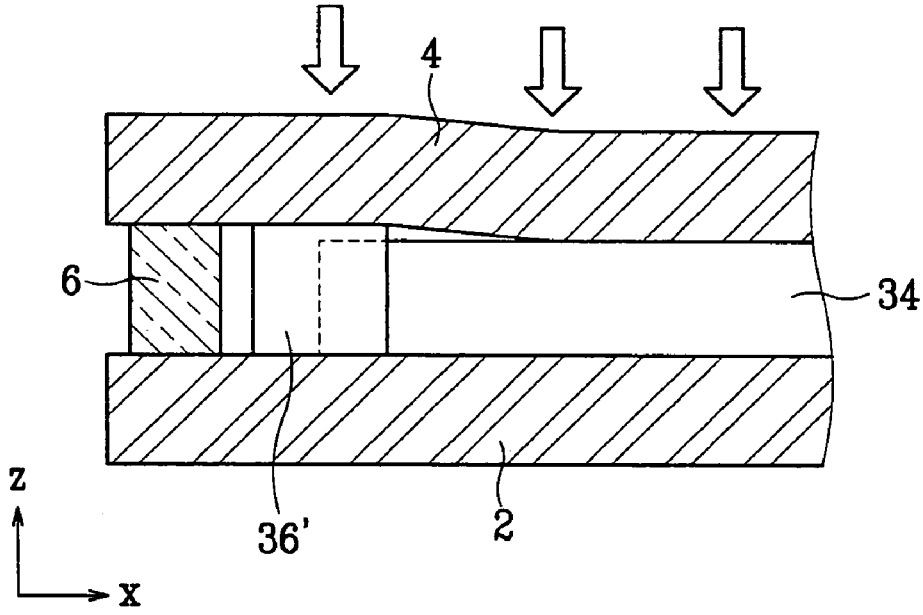

Turning now to FIGS. 6 and 7, FIGS. 6 and 7 illustrate how the spacer supports 36' reduce the impact on the spacers 34 during the exhausting process. As shown in FIG. 6, before evacuating, the spacers 34 and the spacer supports 36' are formed on the first substrate 2, and the first and the second substrates 2 and 4 are sealed to each other by the sealing member 6. When the interior of the sealed substrates 2 and 4 is exhausted through an exhaust port (not shown), the second substrate 4 is in tight contact with the spacer supports 36' as a first impact occurs between the second substrate 4 and the spacer supports 36'.

As shown in FIG. 7, as the evacuation proceeds, the second substrate 4 forms a tight contact with the spacers 34 due to the pressure difference between the interior and exterior of the vacuum vessel as a second impact occurs between the second substrate 4 and the spacers 34. The location and direction of the pressure application are indicated by the arrows of FIGS. 6 and 7.

As the first impact is applied to the spacer supports 36' rather than to the spacers 34 during the exhausting process of the vacuum vessel, the spacer supports 36' reduce the impact applied to the spacers 34 so that the spacers 34 are effectively prevented from being broken or inclined due to the impact applied thereto during the exhausting process. The height difference between the spacer supports 36' and the spacers 34 is preferably 10% or less of the height of the spacers 34, so that an occurrence of a crack occurrence in the second substrate 4 due to the height difference between the spacer supports 36' and the spacers 34 can be avoided.

Meanwhile, compared to the spacers 34, since the spacer supports 36' are located in the non-active area 32, the spacer supports 36' can be designed to have a larger width than the spacers 34. Preferably, the spacer supports 36' are formed as wide as possible provided that the spacer supports 36' do not result in an increase of weight for the vacuum vessel and for the electron emission display device.

Figure 8:
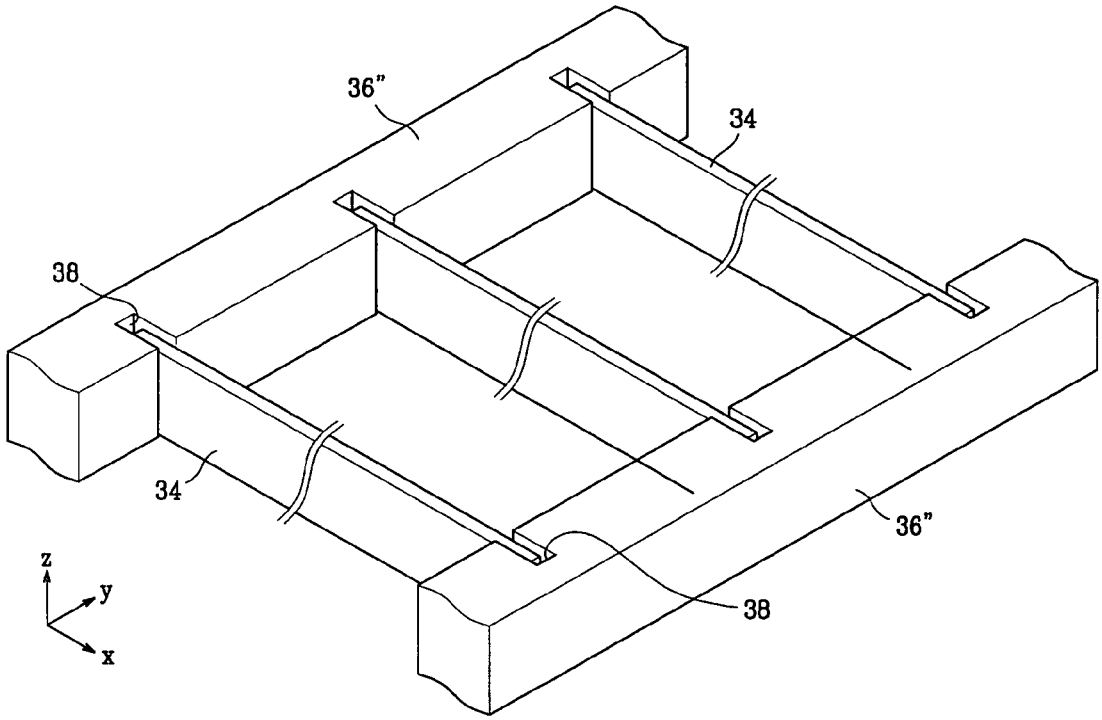
FIG. 8 is a perspective view of the spacers and the spacer supports, illustrating a second variant of the spacer supports.

Turning now to FIG. 8, FIG. 8 shows yet another variation in the design for the spacer supports 36". As shown in FIG. 8, the spacer supports 36" can be integrated as a single body, each containing a plurality of grooves 38 while extending in a direction of either the long or the short axis of the active area 30. When the spacer support 36" have such an integrated structure, the spacer supports 36" can more effectively serve to absorb and withstand the pressure experienced in the non-active area 32.

Figure 9:
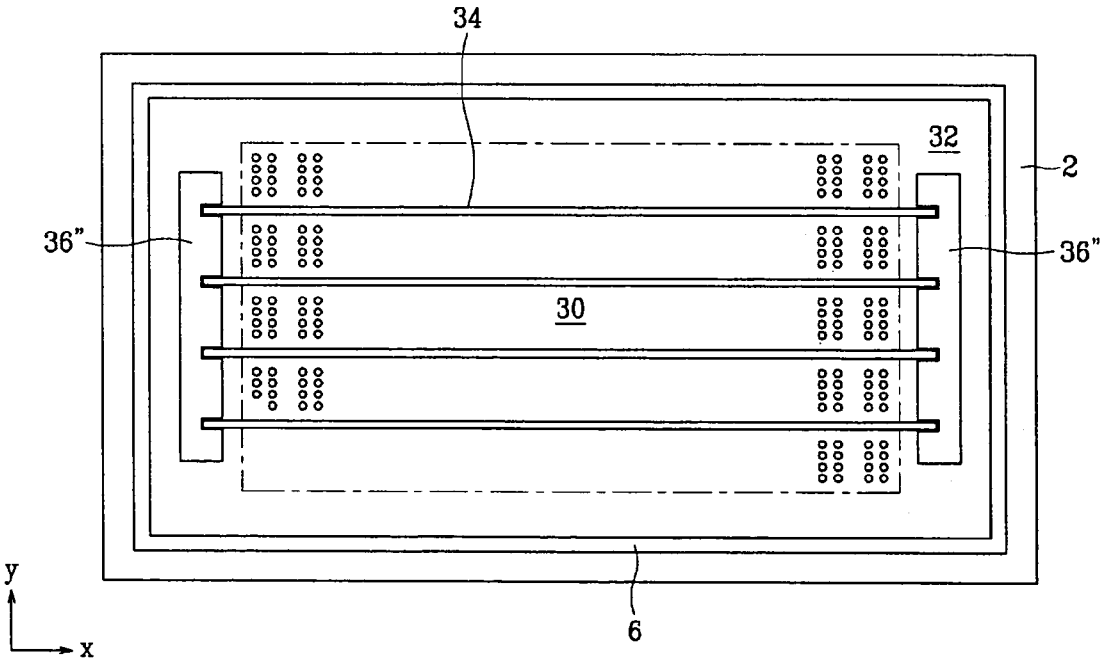
FIG. 9 is a plan view of the structural components of an electron emission display device absent the second substrate according to the second variant of the spacer supports.

Turning now to FIG. 9, FIG. 9 shows the spacer supports 36" of FIG. 8 arranged on a first substrate 2. In FIG. 9, the single-bodied spacer supports 36" are arranged parallel to the direction of the short axis of the active area 30 (i.e., in the direction of the y axis of the drawing), and spacers 34 are inserted into grooves in the spacer supports 36".

One additional design consideration of the present invention pertains to the distance between opposite support spacers. As shown in FIGS. 4, 5 and 8 with spacer supports 36, 36' and 36" respectively, the distance between the grooves 38 placed opposite to each other is established to be slightly larger than the length of the spacers 34 so that there will be a marginal space in which the spacer 34 can move in the longitudinal direction. The purpose for this marginal space is that if there is an increase in temperature which leads to an expansion of the spacers 34, the spacers 34 can easily expand within the this marginal space of the grooves 38 so that twisting and breakage thereof can be prevented.

The spacers 34 can be made out of any of ceramic, glass, glass-ceramic mixture, ceramic tape, ceramic sheet, or ceramic reinforced glass. The spacer supports 36, 36' and 36" can be made out of a material having a thermal expansion coefficient identical to or close to that of the spacers 34. The support spacers 36, 36' and 36" can thus be made out of the same material as the spacers 34.

Although exemplary embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A vacuum vessel, comprising:

a first and a second substrate facing each other and extending across both an active area and a non-active area surrounding the active area;

a sealing member arranged at peripheries of the first and the second substrates and adapted to maintain a vacuum between the two substrates;

a plurality of wall type spacers arranged between the first and the second substrates while extending across the active area; and a plurality of spacer supports arranged in the non-active area between the first and the second substrates, the plurality of spacer supports including a plurality of grooves adapted to receive the ends of respective ones of the plurality of wall type spacers, each spacer support having a height greater than a height of the plurality of wall type spacers, wherein the plurality of spacer supports are separate and distinguished from the sealing member.

2. The vacuum vessel of claim 1, wherein each of the spacer supports includes one groove adapted to receive one end of the wall type spacers, and each of the wall type spacers corresponds to a pair of the spacer supports.

3. The vacuum vessel of claim 1, wherein the vacuum vessel comprises two spacer supports, each of said two spacer supports including a plurality of grooves adapted to accommodate ends of corresponding ones of said plurality of wall type spacers.

4. The vacuum vessel of claim 1, wherein a distance between a pair of the plurality of grooves that are arranged opposite to each other with one of said plurality of wall type spacers arranged between is larger than a length of said one of said plurality of wall type spacers to define a marginal space between said one of said plurality of wall type spacers and a pair of the plurality of spacer supports that are arranged opposite to each other with said one of said plurality of wall type spacers.

5. The vacuum vessel of claim 1, wherein a height difference between each of said plurality of wall type spacers and each of said plurality of spacer supports is no more than 10% of a height of each of said plurality of wall type spacers.

6. The vacuum vessel of claim 1, further comprising an adhesive adapted to attach the plurality of spacer supports to one of the first and the second substrates.

7. The vacuum vessel of claim 1, each of said plurality of spacer supports being a single integrated monolithic unit.

8. An electron emission display device, comprising:

a first and a second substrate facing each other and extending across both an active area and a non-active area surrounding the active area;

an electron emission unit arranged within the active area and on the first substrate;

a light emission unit arranged within the active area and on the second substrate;

a sealing member arranged at peripheries of the first and the second substrates and adapted to maintain a vacuum between the first and the second substrates;

a plurality of wall type spacers arranged between the first and the second substrates while extending across the active area; and a plurality of spacer supports arranged in the non-active area between the first and the second substrates, the plurality of spacer supports including a plurality of grooves adapted to receive ends of the respective ones of the plurality of wall type spacers, each spacer support having a height greater than a height of the plurality of wall type spacers, wherein the plurality of spacer supports are separate and distinguished from the sealing member.

9. The electron emission display device of claim 8, wherein each of the spacer supports includes one groove adapted to receive one end of the wall type spacers, and each of the wall type spacers corresponds to a pair of the spacer supports.

10. The electron emission display device of claim 8, wherein the electron emission display device comprises two spacer supports, each of said two spacer supports having a plurality of grooves, each groove adapted to accommodate one end of corresponding one said plurality of wall type spacers.

11. The electron emission display device of claim 8, wherein a distance between a pair of the plurality of grooves that are arranged opposite to each other with one of said plurality of wall type spacers arranged between is larger than a length of said one of said plurality of wall type spacers to define a marginal space between said one of said plurality of wall type spacers and a pair of the plurality of spacer supports that are arranged opposite to each other with said one of said plurality of wall type spacers.

12. The electron emission display device of claim 8, wherein a height difference between each of said plurality of wall type spacers and each of said plurality of spacer supports is no more than 10% of a height of each of said plurality of wall type spacers.

13. The electron emission display device of claim 8, further comprising an adhesive adapted to attach each of the plurality of spacer supports to one of the first and the second substrates.

14. The electron emission display device of claim 8, wherein the electron emission unit comprises a plurality of electron emission regions adapted to emit electrons and a driving electrode adapted to control the emission of electrons from the plurality of electron emission regions, wherein the light emission unit comprises a plurality of phosphor layers and an anode electrode adapted to apply a high potential to the plurality of phosphor layers.

15. An electron emission display device, comprising:

a first substrate spaced apart from and facing a second substrate and spanning an active area and a non-active area surrounding the active area;

an electron emission unit arranged on the first substrate within the active area;

a light emission unit arranged on the second substrate within the active area;

a sealing member arranged at peripheries of the first and the second substrates and in the non-active area, the sealing member being adapted to maintain a vacuum between the first and the second substrates;

a plurality of wall type spacers arranged between the first and the second substrates and extending across the active area, the plurality of wall type spacers being adapted to keep said first substrate spaced apart from the second substrate and to absorb and withstand a pressure in the active area acting on the first and the second substrates due to said vacuum between the first and the second substrates; and a plurality of spacer supports arranged within the non-active area between the first and the second substrates at opposite ends of ones of the plurality of wall type spacers, the plurality of spacer supports being adapted to keep said first substrate spaced apart from said second substrate and to absorb and withstand a pressure in the non active area acting on the first and the second substrates due to said vacuum between the first and the second substrates, each of the plurality of spacer supports being separate and distinguished from the sealing member and having a height greater than a height of each of the plurality of wall type spacers.

16. The electron emission display device of claim 15, each of the plurality of spacer supports being wider than each of the plurality of wall type spacers.

17. The electron emission display device of claim 15, each of the plurality of spacer supports being taller than each of the plurality of wall type spacers by no more than 10% of a height of each of the plurality of wall type spacers.

18. The electron emission display device of claim 15, the plurality of wall type spacers being of a stripe pattern.

19. The electron emission display device of claim 15, each of the plurality of spacer supports comprising one groove adapted to receive one end of one of said plurality of wall type spacers.

20. The electron emission display device of claim 15, each of the plurality of spacer supports comprising a plurality of grooves adapted to receive one end of a corresponding plurality of wall type spacers.

* * * * *